United States Patent [19]

Labbe

[11] Patent Number: 4,543,967

[45] Date of Patent: Oct. 1, 1985

[54] CIGARETTE MANUFACTURE

[75] Inventor: Francis A. M. Labbe, Neuilly-sur-Seine, France

[73] Assignee: Molins PLC, London, England

[21] Appl. No.: 463,851

[22] Filed: Feb. 4, 1983

[51] Int. Cl.[4] ..... A24C 5/18

[52] U.S. Cl. ..... 131/84.3; 131/61.1; 131/84.4

[58] Field of Search ..... 131/84 R, 84 A, 84 B, 131/84 C, 85, 87, 61 R

[56] References Cited

U.S. PATENT DOCUMENTS

| | | | |
|---|---|---|---|
| 1,723,942 | 8/1929 | Koerner | 131/84 R |
| 2,660,178 | 11/1953 | Rault | 131/84 B |
| 2,748,776 | 6/1956 | Molins | 131/61 A |
| 3,088,468 | 5/1963 | Labbe | 131/84 C |
| 3,306,304 | 2/1967 | Molins et al. | 131/84 B |
| 3,624,722 | 11/1971 | Stone | 131/84 R |
| 3,736,941 | 6/1973 | Molins et al. | 131/84 C |
| 3,949,763 | 4/1976 | Labbe et al. | 131/84 B |
| 3,989,052 | 11/1976 | Brackmann et al. | 131/84 B |
| 4,164,229 | 8/1979 | Hurt | 131/84 C |
| 4,397,320 | 8/1983 | Labbe | 131/84 B |
| 4,417,594 | 11/1983 | Garrone | 131/84 C |

FOREIGN PATENT DOCUMENTS

| | | | |
|---|---|---|---|
| 1340201 | 12/1973 | United Kingdom | 131/84 B |
| 2023401 | 1/1980 | United Kingdom | 131/84 A |

*Primary Examiner*—V. Millin
*Assistant Examiner*—H. Macey
*Attorney, Agent, or Firm*—Antonelli, Terry & Wands

[57] ABSTRACT

A machine for making oval cigarettes has a channel, through which tobacco is showered towards a suction conveyor, formed by walls which diverge in cross-section along at least part of the tobacco-receiving section of the conveyor so as to form a filler stream which is denser at the middle than it is at the sides, the angle of divergence being preferably at least 15° (e.g. 19°). In the garniture area of the machine, the cigarette filler stream is initially shaped without being significantly compressed, and is then compressed vertically by a tongue to form the desired oval cross-section (with a horizontal major axis); while the filler stream is being vertically compressed by the tongue, the garniture bed allows the radius of curvature of the underneath surface of the filler stream to increase progressively to the final value.

19 Claims, 4 Drawing Figures

34
18
28B
28A
34
12
42
20
44
42
40
38
E.
40
40A
44C
38
B.
36
44A
38
F.
40
40A
38
C.
36
44B
38
G.
18A
42
40
40A
38
D.
36
44C
38
H.
44
38

CIGARETTE MANUFACTURE

This invention is concerned with the manufacture of cigarettes of oval or approximately oval cross-section. In particular, this invention is concerned with the manufacture of oval cigarettes by means of machines of the type exemplified by the Molins MK8 and MK9 cigarette making machines, with tobacco of relatively coarse cut of the type common in Russia.

In known machines of the above-mentioned type, a filler stream is formed and is fed onto a wrapper web which is carried through a garniture by a garniture tape running on a garniture bed defining the cross-sectional shape of the garniture tape at various positions along the garniture, the filler stream being compressed by filler shaping means (in particular a tongue) engaging the top of the filler stream until the filler stream has substantially the cross-section of the finished cigarette rod, after which the wrapper web is completely folded around the filler stream and is secured to form a continuous cigarette rod.

According to one aspect of the present invention, a machine of that type is characterised in that the cross-sectional shape of the garniture tape and wrapper web at the position at which the filler stream arrives on the web corresponds to a trough having an approximately flat bottom area and side portions curved about horizontally spaced centers, that during a first stage of the garniture following the said position, the cross-sectional shape of the garniture tape is arranged to change progressively in that the centers of curvature of the curved side portions move closer together until they become substantially coincident, and that during a second stage of the garniture the filler stream is progressively compressed (reduced in cross-sectional area) by the filler shaping means while the radius of curvature of the garniture tape is arranged to increase progressively so as to allow the side portions of the filler stream to be bent downwards.

In a preferred machine according to this invention, and this feature may be useful in its own right in the manufacture of oval cigarettes, the filler shaping means is arranged to shape the filler stream (which is initially rectangular in cross-section) to form curved upper and lower surfaces before any significant compression of the filler stream is effected. Preferably the compression stage comprises vertically compressing the filler stream, with substantially no horizontal compression; that is to say, the horizontal width of the filler stream delivered onto the wrapper web is approximately equal to the width (the major axis) of the finished oval cigarette, compression of the filler stream to form the finished cigarette affecting substantially only the vertical dimensions of the filler stream. For that purpose, it is desirable to produce an initial filler stream with less tobacco per unit of width at the side; that may be achieved in accordance with the second aspect of the invention mentioned below.

According to a second aspect to this invention, which is preferably used in combination with the first aspect of this invention, a cigarette making machine for manufacturing oval cigarettes includes a shower channel through which tobacco is arranged to be showered towards a suction conveyor on which the filler stream is formed, the shower channel comprising walls extending along opposite edges of the suction conveyor and having internal surfaces which, in the region close to the suction conveyor, diverge by a substantial angle towards the suction conveyor. By this means, the flow of tobacco towards the suction conveyor is concentrated towards the center of the suction conveyor (as viewed in cross-section), less tobacco being delivered to regions close to the edges of the suction conveyor. Preferably the shower channel extends upwards towards a suction conveyor running across the top of the shower channel, as in the Molins MK8 and MK9 machines. The angle of divergence of the inner surfaces of the wall in the region close to the suction conveyor is preferably at least 15 degrees; that is, each inner surface is inclined to the vertical by at least 7½ degrees.

An example of a machine according to this invention is shown in the accompanying drawings. In these drawings.

Figure 1:
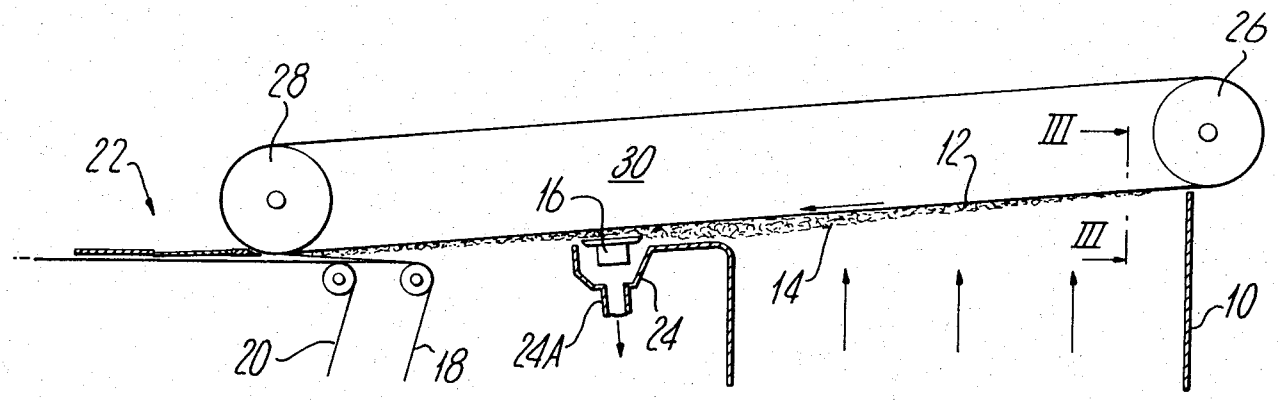
FIG. 1 is a diagrammatic elevation of a machine basically like the Molins MK9 cigarette machine.

As shown in FIG. 1, tobacco is showered upwards through a chimney 10 towards the lower run of a suction conveyor 12 (i.e. a conveyor carrying the filler stream by means of suction) to form a filler stream 14. A trimming device 16 removes part of the filler stream, the remainder being deposited upon a continuous wrapper web 18 which is carried through a rod-forming section or garniture by a garniture tape 20.

Figure 3:
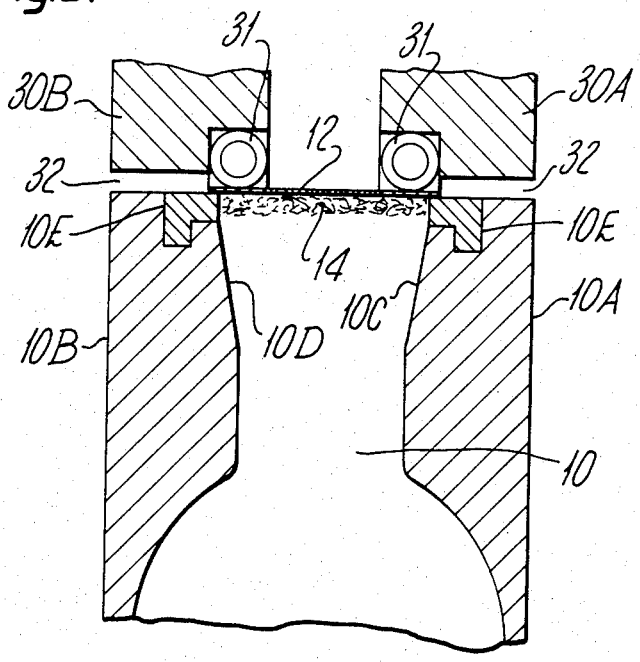
FIG. 3 is a section on the line III—III in FIG. 1.

A continuous cigarette rod is formed by enclosing the filler stream in the wrapper 18, and this is achieved by means of the rod-forming part of the machine, part of which is shown generally at 22 and is shown in greater detail in FIGS. 3 and 4.

Tobacco removed from the filler stream by the trimming device 16 is conveyed from an enclosure 24 around the trimming device via an outlet 24A. The enclosure 24 is maintained at below atmospheric pressure, the arrangement in that area being generally as described in out British Patent Specification No. 1340201 or No. 2023401.

The conveyor 12 passes around two pulleys 26 and 28. Suction is transmitted through the conveyor 12 (which is porous or perforated) from a suction chamber 30 in order to hold the filler stream on the underneath surface of the conveyor.

FIG. 3 is a cross-section at a position where the filler stream 14 is only partially formed. The channel 10 is defined by front and back walls 10A and 10B which, at their upper ends, have diverging inner surfaces 10C and 10D in accordance with the second aspect of this invention. Each of the surfaces 10C and 10D is inclined to the vertical by 9½°. In the usual Molins MK8 or MK9 machine, the surfaces 10C and 10D are parallel (i.e. vertical); however, the provision of a degree of divergence is not new, being shown in our British Patent Specification No. 914821, which specification was not concerned with the manufacture of oval cigarettes.

The conveyor 12 is drawn upwards by suction and is supported against coil spring bands 31 which move with and support the opposite edges of the conveyor 12. Fixed inserts 10E set into the walls 10A and 10B trap the edges of the bands. In order to prevent tobacco entering the gaps between the conveyor 12 and the inserts 10E, there are longitudinally extending air inlet slots 32 which are formed between the walls 10A, 10B and walls 30A, 30B of the suction chamber. Air is drawn in through these slots by virtue of the suction pressure at the upper end of the channel 10.

As a result of the pronounced divergence of the surfaces 10C and 10D, tobacco reaching the conveyor 12 from the channel 10 forms a layer (the filler stream) which has a lower density at the sides. This is desirable because the final vertical compression of the filler stream (as described below) reduces the height of the filler stream to a most pronounced degree at the sides, and it is desirable to avoid excessive tobacco density at the sides; that is to say, at the ends of the major axis of the oval cross-section.

Figure 2:
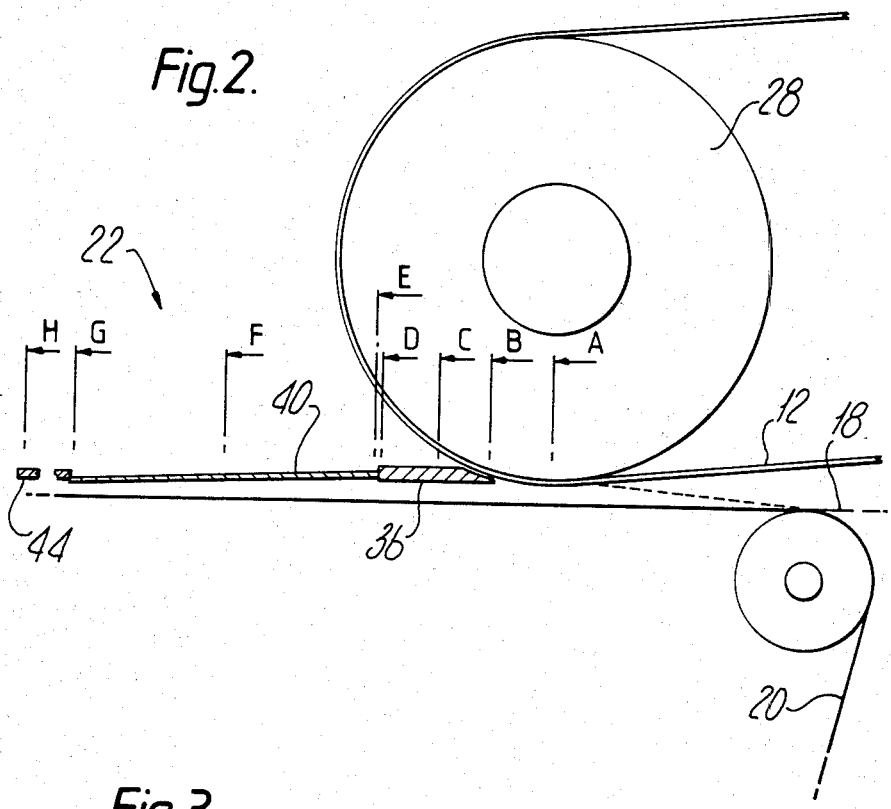
FIG. 2 is an enlargement of part of FIG. 1.
Figure 4A:
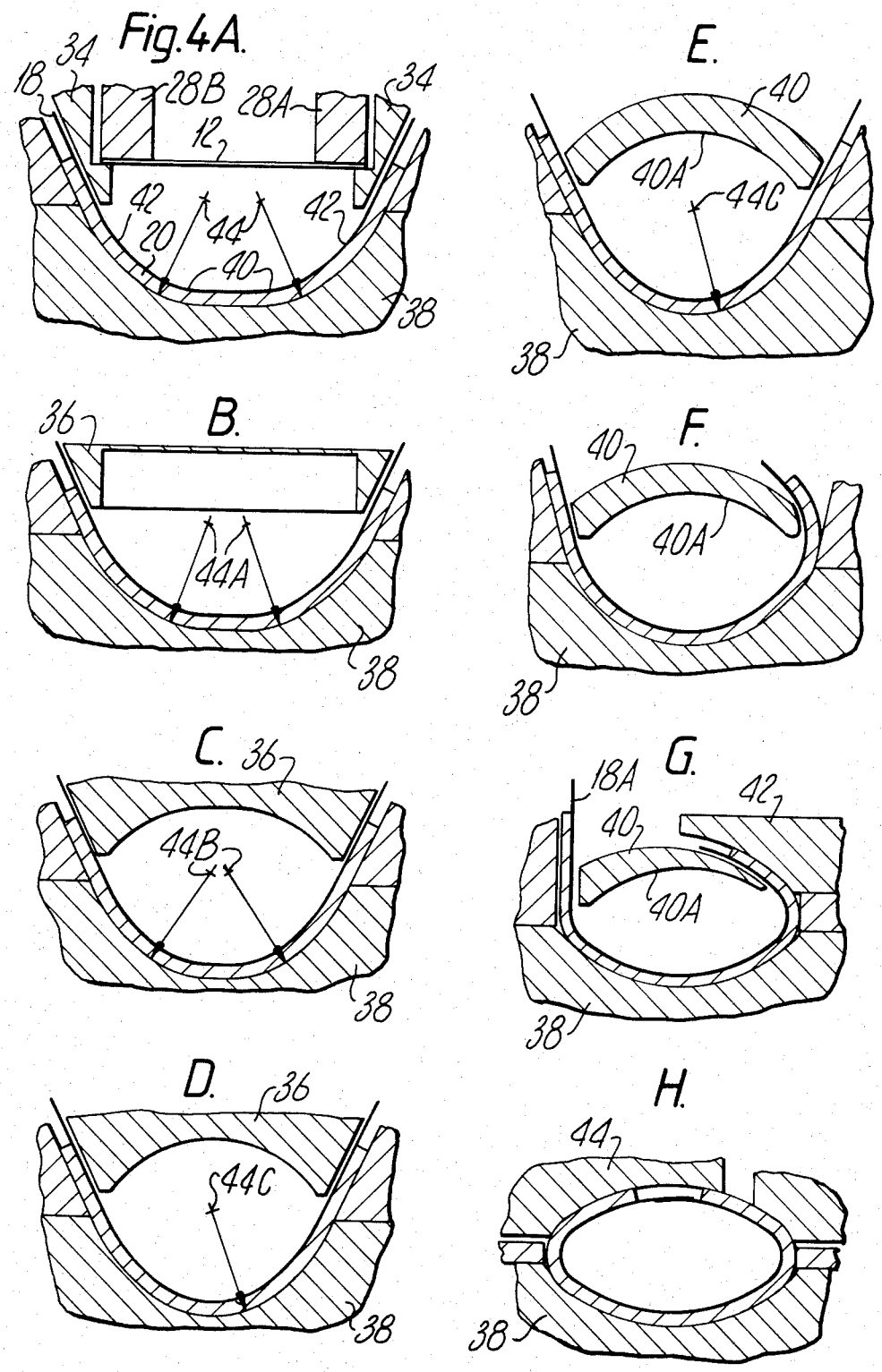
FIG. 4 shows vertical sections at positions A to H in FIG. 2.

On being deposited on the wrapper 18 (at stage A in FIG. 2) the cigarette filler stream is immediately shaped in the region of its lower surface by virtue of the fact that the wrapper 18 is trough-shaped at that position, as shown in FIG. 4A. The upper surface of the filler is flat, being defined by the conveyor 12 which, at the transfer point, is returning around the pulley 28. In order to allow suction to be transmitted to the conveyor 12 until the transfer point, the pulley 28 is hollow, comprising spaced walls 28A and 28B supporting the respective rear and front edges of the conveyor 12. Fixed side rails 34 confine the sides of the filler stream while it is being carried by the conveyor 12, in the region of the pulley 28 and are appropriately shaped at position A to assist in forming the wrapper 18 into the required shape; the rails 34 terminate shortly downstream of the position A, whereupon the upper surface and upper parts of the sides of the filler stream are confined by a shoe 36 which helps to remove the filler stream from the conveyor 12.

The shoe 36 in cooperation with a garniture bed 38 (which defines the shape of the garniture tape 20 and hence of the wrapper 18) causes the cross-sectional shape of the filler stream to change progressively as shown in FIGS. 4B, 4C and 4D. The filler stream is then vertically compressed by a tongue 40, during which process its shape changes progressively as shown in FIGS. 4E to 4G, the final shape being shown in FIG. 4H. The progression towards the final shape of the filler stream will now be described.

As shown in FIG. 4A, the trough-shaped cross-section of the wrapper 18 initially includes a substantially flat bottom area 41 on each side of which there is a curved section 42 of which the centers of curvature are at points 44. At this stage, by way of example, the height of the filler stream is 6 mm; the radius of curvature of each side portion of the garniture bed centered about the corresponding point 44 is 4.95 mm. From position A through to position D, the curved side portions 42 of the wrapper are constrained to move progressively horizontally closer together while each radius of curvature remains constant. The displacement of the center of curvature is clearly shown in FIGS. 4A to D, the centers of curvature in FIGS. 4B to D being shown respectively as points 44A, 44B and 44C. It should be noted that, at position D (at the downstream end of the shoe 36) the centers of curvature are coincident, so that the bottom surface of the wrapper forms part of a circle in cross-section. It is important to note that the cross-section of the wrapper, where it is in contact with the filler stream, is shaped at position D (and E) substantially like the lower end of a vertical ellipse, such that the mass per unit width of the filler stream at that stage is as in the final cigarette.

The bottom surface of the shoe 36 changes progressively from a flat shape to a curved shape between positions B and C, during which process the height of the filler stream remains substantially constant at 7.6 mm. Between positions C and D, the shape of the shoe changes very slightly, as shown, without reducing the height of the filler stream, and without significantly reducing the cross-sectional area of the filler stream, though the lower portion of the filler stream becomes slightly narrower as a result of the inward displacement of the curvature centers 44. The final shape of the shoe is a curve of radius 6 mm.

As the filler stream passes under the tongue 40, it is progressively vertically compressed, while the garniture bed 38 is shaped to allow the radius of curvature of the lower surface of the filler stream to increase progressively. More specifically, the radius of curvature of the garniture bed increases progressively from 4.95 mm to 7.1 mm, thus allowing the side portions of the filler stream to be bent downwards. During this process, the underneath surface 40A of the tongue retains substantially the same shape, being a curve of 6.3 mm radius, but is downwardly displaced in order to achieve the desired vertical compression of the filler stream. From its upstream end to its downstream end, the highest point of the surface 40A of the tongue is reduced in height from 7.9 mm to 5.2 mm above the bottom surface of the filler stream as defined by the wrapper.

While the tongue 40 is vertically compressing the filler stream, the rear edge of the wrapper is progressively folded over the tongue by a first folding member 42 (see FIG. 4G). At the same time, the front edge 18A of the wrapper is brought to a vertical position to allow a strip of adhesive to be applied to its inner face by an appropriate gluing device (not shown). Downstream of the gluing device there is a second folding member 44 which bends downwards the front edge 18A of the paper so as to press that edge onto the rear edge and form the appropriate seam. Downstream of the second folding member 44 there is a heater (not shown) which bears on the seam to set the adhesive.

The cross-section of the finished cigarette, as shown in FIG. 4H, consists of upper and lower surfaces having the same relatively large radius, and side surfaces having the same relatively small radius. This shape is not strictly an oval. However, the term "oval" is not intended in this context to have a strict geometrical meaning. Indeed, this invention is applicable to the manufacture of cigarettes of non-circular cross-section other than that shown in the drawings, provided the width is greater than the height so as to require less tobacco per unit area of width at the sides as compared with the middle of the cigarette.

In the arrangement described above, particularly with reference to FIG. 3, the parts 10C and 10D of the channel walls diverge by the same angle at various positions along the suction conveyor 12. As an alternative they could extend vertically in the region of the pulley 26 (i.e. where tobacco first arrives on the conveyor), and then diverge progressively at successive positions further to the left as seen in FIG. 1, the final angle of divergence (where the filler stream is fully formed) being, for example, as shown in FIG. 3.

As already mentioned, the bottom area 41 of the wrapper (FIG. 4A) is initially substantially flat. In practice it could be slightly curved, though with a radius of curvature considerably larger than that of the curved side sections 42.

We claim:

1. A cigarette making machine for making cigarettes of oval cross-section, including means for forming a filler stream and for feeding the filler stream on to a wrapper web which is carried through a garniture by a garniture tape running on a garniture bed having a guide surface defining the cross-sectional shape of the garniture tape at successive positions along the garniture bed, the filler stream being compressed to the cross-section of the finished cigarette by filler shaping means engaging the top of the filler stream whereby the said shaping means, in combination with the guide surface of the garniture bed, forms the filler stream into the required oval cross-section; and including means for thereafter folding the wrapper web completely around the filler stream and for securing the wrapper web to form a continuous cigarette rod, the garniture bed having a first part including means to form the cross-sectional shape of the garniture tape and wrapper web, at the position at which the filler stream arrives on the web, into the form of a trough having an approximately flat central portion with side portions curved about two horizontally spaced centers of curvature, a second part including means to cause the cross-sectional shape of the garniture tape to change progressively in that the said centers of curvature of the curved side portions move closer together while the radius of curvature of each of said side portions remains substantially constant and a third part in the region of which the filler shaping means including means to progressively compress the filler stream, and the guide surface causes said central portion of the garniture tape and wrapper web to assume a curve of radius larger than the said radii of curvature of the side portions a the first and second parts of the garniture bed.

2. A cigarette making machine according to claim 1 in which the filler shaping means includes a first part which is arranged to shape the upper surface of the filler stream, in the region of the second part of the garniture bed, without significantly compressing the filler stream.

3. A cigarette making machine according to claim 2 in which the cross-sectional shape of the first path of the filler shaping means changes progressively from being flat to being a curve approximately corresponding to the shape of the upper surface of the completed cigarette, and in which a second part of the filler shaping means is arranged to compress the filler stream vertically downwards while maintaining the shape of the upper surface of the filler stream substantially unchanged.

4. A cigarette making machine according to claim 3 in which means defining the dimensions of the filler stream which is delivered onto the wrapper web are arranged to form the filler stream with a horizontal width approximately equal to the width (the major axis) of the finished oval cigarette.

5. A cigarette making machine according to claim 4, including a shower channel through which tobacco is arranged to be showered towards a suction conveyor on which the filler stream is formed, the shower channel comprising walls extending along opposite edges of the suction conveyor and having internal surfaces which, in the region close to the suction conveyor, diverge by a substantial angle towards the suction conveyor.

6. A cigarette making machine according to claim 5 in which the shower channel extends upwards, the suction conveyor being arranged to run across the top of the shower channel.

7. A cigarette making machine according to claim 5 in which the angle of divergence of the inner surfaces of the walls in the region close to the suction conveyor is such that the each inner is inclined to the vertical by at least $7\frac{1}{2}$ degrees.

8. A method of making cigarettes of oval cross-section, in which a filler stream is formed and is fed onto a wrapper web which is carried through garniture means by a garniture tape running on a garniture bed having a guide surface defining the cross-sectional shape of the garniture tape at successive positions along the garniture bed, the filler stream being compressed to the cross-section of the finished cigarette rod by filler shaping means engaging the top of the filler stream, whereby the said shaping means in combination with the guide surface of the garniture bed forms the filler stram into the required oval cross-section, after which the wrapper web is completely folded around the filler stream and is secured to form a continuous cigarette rod, the cross-sectional shape of the garniture tape and wrapper web at the position at which the filler stream arrives on the web corresponding to a trough having an approximately flat central portion with side portions curved about two horizontally spaced centers of curvature, and said cross-sectional shape during a subsequent stage of the garniture means following the said position changing progressively in that the said centers of curvature of the curved side portions move closer together while the radius of curvature of said side portions remains substantially constant and including a further stage of the garniture means in which the filler shaping means progressively compresses the filler stream, and said guide surface causes the central portion of the garniture tape and wrapper web to assume a curve of radius larger than the said radii of curvature of the side portions.

9. A method according to claim 8, in which the initial shaping of the upper surface of the filler stream by the filler shaping means is effected without significantly compressing the filler stream.

10. A cigarette making machine for making cigarettes of oval cross-section, having garniture means for shaping and compressing a cigarette filler stream and for wrapping a continuous wrapper web around the filler stream to form a continuous cigarette rod, the said garniture means including a garniture tape which carries the wrapper and is itself supported by a garniture bed defining the cross-sectional shape of the garniture tape at various positions along the garniture means, the garniture bed being so shaped as to form the garniture tape into a relatively deep cross-section at a first position, and to permit the garniture tape to change towards a shallower trough-shaped cross-section as it moves towards a second position downstream of the first position, the said shallower trough-shaped cross-section corresponding to the cross-sectional shape of the lower portion of the cigarette rod.

11. A method according to claim 9 in which the filler stream, at the position where it is delivered onto the wrapper web, has a horizontal width approximately equal to the width (the major axis) of the finished oval cigarette.

12. A method according to claim 11 in which the filler stream is formed by showering tobacco through a shower channel and towards a suction conveyor, the walls of the shower channel extending along opposite edges of the suction conveyor and having internal surfaces which, in the region close to the suction conveyor, diverge by a substantial angle towards the suction conveyor.

13. A method according to claim 12 in which the tobacco is showered in an upward direction through the shower channel, the suction conveyor being arranged to run across the top of the shower channel.

14. A method according to claim 12 in which the angle of divergence of the inner surfaces of the walls in the region close to the suction conveyor is such that each surface is inclined to the vertical by at least 7½ degrees.

15. A cigarette making machine for making cigarettes of oval cross-section, in which a filler stream is formed and is fed onto a wrapper web which is carried through a garniture by a garniture tape running on a garniture bed defining the cross-sectional shape of the garniture tape, the filler stream being compressed to the cross-section of the finished cigarette rod by filler shaping means engaging the top of the filler stream, after which the wrapper web is completely folded around the filler stream and is secured to form a continuous cigarette rod, characterized in that the cross-sectional shape of the garniture tape and wrapper web at the position at which the filler stream arrives on the web corresponds to a trough having an approximately flat bottom area and side portions curved about horizontally spaced centers, so that during a first stage of the garniture following the said position the cross-sectional shape of the garniture tape is arranged to change progressively in that the centers of curvature of the curved side portions move closer together until they become substantially coincident, and that during a second stage of the garniture the filler stream is progressively compressed so as to be reduced in cross-sectional area by the filler shaping means while the radius of curvature of the garniture tape is caused to increase progressively so as to cause the wrapper web to be bent downwards and the side portions of the filler stream to be compressed.

16. A method of making cigarettes of oval cross-section, in which a filler stream is formed and is fed onto a wrapper web which is carried through garniture means by a garniture tape running on a garniture bed defining the cross-sectional shape of the garniture tape, the filler stream being compressed to the cross-section of the finished cigarette rod by filler shaping means engaging the top of the filler stream, after which the wrapper web is completely folded around the filler stream and is secured to form a continuous cigarette rod, characterized in that the cross-sectional shape of the garniture tape and wrapper web at the position at which the filler stream arrives on the web corresponds to a trough having an approximately flat bottom area and side portions curved about horizontally spaced centers, so that during a first stage of the garniture means following the said position the cross-sectional shape of the garniture tape is arranged to change progressively in that the centers of curvature of the curved side portions move closer together until they become substantially coincident, and that during a second stage of the garniture means the filler stream is progressively compressed so as to be reduced in cross-sectional area by the filler shaping means while the radius of curvature of the garniture tape is caused to increase progessively so as to cause the wrapper web to be bent downwards and the side portions of the filler stream to be compressed.

17. A cigarette making machine for making cigarettes of oval cross-section comprising means for forming a cigarette filler stream of substantially rectangular cross-section having a width substantially equal to the length of the major axis of the finished cigarettes and having side portions of relatively low density; a suction conveyor for carrying said filler stream; shaping means located downstream of the suction conveyor for shaping the filler stream to form the upper and lower surfaces of the filler stream into substantially convex shapes in cross-section, said shaping means including shoe means for assisting in the removal of the filler stream from the suction conveyor and for thereafter shaping the filler stream without significantly compressing it; and tongue means for progressively compressing the filler stream vertically towards the desired oval cross-section while the filler stream is being conveyed forward with the aid of a garniture tape.

18. A method according to claim 10 in which during such initial shaping, the cross-sectional shape of the filler shaping means changes progressively from being flat to being a curve approximately corresponding to the shape of the upper surface of the completed cigarette, whereafter the filler shaping means compresses the filler stream vertically downwards while maintaining the shape of the upper surface of the filler stream substantially unchanged.

19. A cigarette making machine for making cigarettes of oval cross-section, having garniture means for shaping and compressing a cigarette filler stream and for wrapping a continuous wrapper web around the filler stream to form a continuous cigarette rod, the said garniture means including a garniture tape which carries the wrapper and is itself supported by a garniture bed defining the cross-sectional shape of the garniture tape at various positions along the garniture means, said garniture bed including means for forming the garniture tape initially to have a shallow trough-shaped cross-section and then to change into a relatively deep trough-shaped cross-section at a first position, and for permitting the garniture tape to further change towards a shallower trough-shaped cross-section at the second position corresponding to the cross-sectional shape of the lower portion of the cigarette rod.

* * * * *